US005172497A

United States Patent [19]

Lemonds et al.

[11] Patent Number: 5,172,497

[45] Date of Patent: Dec. 22, 1992

[54] SLURRY DENSITY CONTROL SYSTEM

[75] Inventors: Stephen C. Lemonds, Gretna; Huey Legendre; Randy L. Steed, both of Marrero, all of La.; Virgil H. Thomas, Jacksonville, Fla.

[73] Assignee: Lor, Inc., Atlanta, Ga.

[21] Appl. No.: 782,517

[22] Filed: Oct. 25, 1991

[51] Int. Cl.[5] ..... E02F 3/88

[52] U.S. Cl. ..... 37/59; 37/58; 37/DIG. 1; 406/19

[58] Field of Search ..... 37/58, 59, 54, 61-63, 37/DIG. 1; 406/14, 19, 30, 31, 34, 35

[56] References Cited

U.S. PATENT DOCUMENTS

| | | | |
|---|---|---|---|
| 2,603,234 | 7/1952 | Hofer . | |
| 2,938,536 | 5/1960 | Ehrenberg . | |
| 3,111,778 | 11/1963 | Fonnesbeck . | |
| 3,119,344 | 1/1964 | Hoffman . | |
| 3,263,615 | 8/1966 | Hofer . | |
| 3,448,691 | 6/1969 | Frazier . | |
| 3,514,881 | 6/1970 | Hadjidakis . | |
| 3,772,805 | 11/1973 | De Koning . | |
| 4,278,365 | 7/1981 | Sandberg . | |
| 4,351,122 | 9/1982 | Cornelis et al. | 37/58 |
| 4,386,473 | 6/1983 | Amann et al. | 37/58 X |
| 4,444,229 | 4/1984 | Beck . | |
| 4,628,623 | 12/1986 | Deal | 37/DIG. 1 X |
| 5,083,386 | 1/1992 | Sloan | 37/DIG. 1 X |

*Primary Examiner*—Randolph A. Reese
*Assistant Examiner*—J. Russell McBee
*Attorney, Agent, or Firm*—Pravel, Gambrell, Hewitt, Kimball & Krieger

[57] ABSTRACT

A suction dredge for mining solids from a water bottom, includes a floating barge, an elongated tubular suction line extending between the barge and the water bottom, a boom for raising and lowering the elongated tubular suction line, a valve in the elongated tubular suction line for allowing water to enter the elongated tubular suction line, a dredge pump for causing solids to be drawn upward from the water bottom, through the elongated tubular suction line, to the floating barge, the dredge pump having a cavitation level at which the vacuum level is so high that the dredge pump ceases to pump, and an automatic control device for controlling the degree of opening of the valve, the automatic control device allowing just enough water to mix with the solids such that the dredge pump is maintained substantially at but below the cavitation level, the automatic control device including a measuring device for measuring the vacuum level of the dredge pump, and causes the valve to open more as the vacuum level rises and to close more as the vacuum level drops.

15 Claims, 5 Drawing Sheets

SLURRY DENSITY CONTROL SYSTEM

BACKGROUND OF THE INVENTION

1. Field of the Invention

The present invention relates to hydraulic dredge apparatus. More particularly, the present invention relates to an apparatus for maintaining the vacuum level of a hydraulic dredge substantially at but just below the point of dredge pump cavitation.

2. General Background

In the hydraulic dredging industry today, the vacuum level is maintained below the point of dredge pump cavitation by increasing power to the pump as the vacuum level drops and decreasing power to the pump as the vacuum levels rises. The amount of power supplied to the dredge pump is controlled by an operator who watches a display of the vacuum level. This method of operation typically results in a vacuum level as shown in FIG. 3 herein.

There are a number of U.S. patents related to hydraulic dredging, including the patents which are listed below, all of which are hereby incorporated by reference.

Fonnesbeck U.S. Pat. No. 3,111,778, discloses a control device for a hydraulic dredge which measures the output pressure of the dredge pump to determine what amount of water to allow to enter the intake pipe. It uses control cables to open and close the water inlet valve.

Ehrenberg U.S. Pat. No. 2,938,536, discloses a valve which shuts down a pipeline near a pump when the pressure on either side of the pump or the flow of liquid through the pipeline adjacent the pump exceeds a predetermined point.

Hofer U.S. Pat. No. 2,603,234, discloses a butterfly relief valve in a hydraulic dredge pipe which automatically opens when there is excess vacuum in the pipe.

Hofer U.S. Pat. No. 3,263,615, discloses a similar relief valve which opens when the vacuum levels at two longitudinally spaced locations in the dredge pipe are equal.

Hoffman U.S. Pat. No. 3,119,344, discloses a hydraulic dredge apparatus which includes means for expelling gas from the dredge pipe.

Frazier U.S. Pat. No. 3,448,691, discloses a dredge apparatus in which a jet pump is used to inject water into a pipe having an intake at one end and a dredge pump at the other end.

Hadjidakis U.S. Pat. No. 3,514,881, discloses an apparatus for adjusting the section slot in a drag suction dredge by vertically adjusting the lower end of the suction pipe.

De Koning U.S. Pat. No. 3,772,805, discloses a dredge in which the lower end of the intake pipe is moved up and down to attempt to control the amount of sand being dredged. A relief valve opens to allow water into the intake pipe if danger of excessive cavitation arises.

Sandberg U.S. Pat. No. 4,278,365, discloses a hydraulic dredge in which solids concentration is controlled by raising and lowering the suction nozzle and increasing and reducing the flow rate of the pump.

Beck U.S. Pat. No. 4,444,209, discloses a system for removing water from a slurry in order to increase the concentration of the slurry. Air is admitted into a chamber as needed to help prevent cavitation.

SUMMARY OF THE PRESENT INVENTION

The present invention is a suction dredge for mining solids from a water bottom comprising a floating barge, an elongated tubular suction line extending between the barge and the water bottom, boom means for raising and lowering the elongated tubular suction line, a valve means in the elongated tubular suction line for allowing water to enter the elongated tubular suction line, dredge pump means for causing solids to be drawn upward from the water bottom, through the elongated tubular suction line, to the floating barge, the dredge pump means having a cavitation level at which the vacuum level is so high that the dredge pump means ceases to pump, and automatic control means for controlling the degree of opening of the valve means, the automatic control means allowing just enough water to mix with the solids such that the dredge pump means is maintained substantially at, but below the cavitation level of the dredge pump means, the automatic control means including measuring means for measuring the vacuum level of the dredge pump means, and causes the valve means to open more as the vacuum level rises and to close more as the vacuum level drops.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

PARTS LIST

Figure 1:
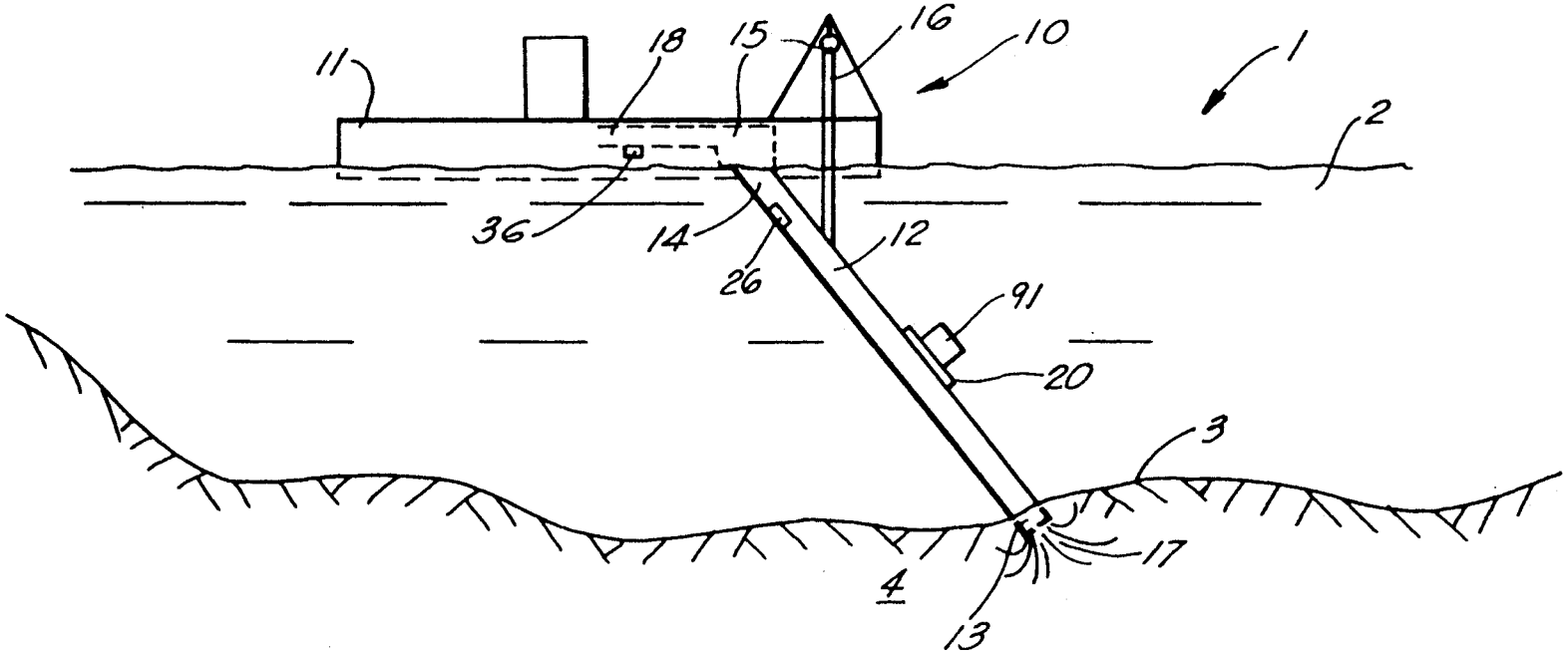
FIG. 1 is a side view of the preferred embodiment of the apparatus of the present invention.

The following table lists the part numbers and part descriptions as used herein and in the drawings attached hereto:

1 Body of water
2 water
3 water bottom
4 material to be dredged
10 Suction dredge apparatus of the preferred embodiment of the present invention
11 barge
12 suction line
13 lower end of suction line 12
14 upper end of suction line 12
15 dredge pump
16 boom for moving suction line 12
17 suction inlet
18 discharge pipe
20 underwater butterfly valve, 18 inch Demco 150 pound wafer, 316 SS Disc
21 vacuum safe light (green)
22 vacuum alarm light (red)
23 vacuum set point control (potentiometer knob)

24 vacuum digital panel meter, Flo-Tech DPM-100
25 digital display of vacuum digital panel meter 24, Barksdale 0-15 PSI
26 transducer for vacuum digital panel meter 24
31 pressure safe light (green)
32 pressure alarm light (red)
34 pressure digital panel meter, Flo-Tech DPM-100
35 digital display of pressure digital panel meter 34
36 transducer for pressure digital panel meter 34, Barksdale 0-100 PSI
40 position indicator of butterfly valve 20, Proximity Controls 15 VDC Certified Submersible
45 output voltage indicator, Proximity Controls 146-001 0-100
50 on/off switch
51 reset button
60 electronics enclosure
61 control panel of electronics enclosure 60
62 engraved panel of control panel 61 of electronics enclosure 60
70 12 VDC regulated power supply
71 24 VDC regulated power supply, 146-002 Proximity Controls isolation transformer
73 MM4010 Wilkerson DC-to-DC signal level conditioning module
74 MM1000 Wilkerson non-latch vacuum limit alarm module
75 MM1010 Wilkerson latch type pressure limit alarm
76 MM4408 Wilkerson A-B subtractor transmitter
77 board mounted diode-resistor clipper network
78 9 VDC resistor network
79 120 VAC 1 4" Muffin cooling fan
91 Superfoss hydraulic piston actuator BRC-012 or BRC-022
92 electrically proportional, directional control valve PVG 32-157N5777
variable volume pressure compensated 6 GPM Denison PV06 pump
94 10 Hp electric motor
95 tank for hydraulic fluid
96 relief valve

DETAILED DESCRIPTION OF THE PREFERRED EMBODIMENT

The apparatus of the present invention comprises hydraulic dredging apparatus 10 including a slurry density control system. Apparatus 10 includes a barge 11, a suction line 12 having a lower end 13 and an upper end 14, a dredge pump 15, a boom 16 for moving suction line 12, and a discharge pipe 18. There is a suction inlet 17 adjacent the lower end 13 of suction line 12. Dredge pump 15 is connected to the upper end 14 of suction line 12 and to discharge pipe 18.

Figure 2:
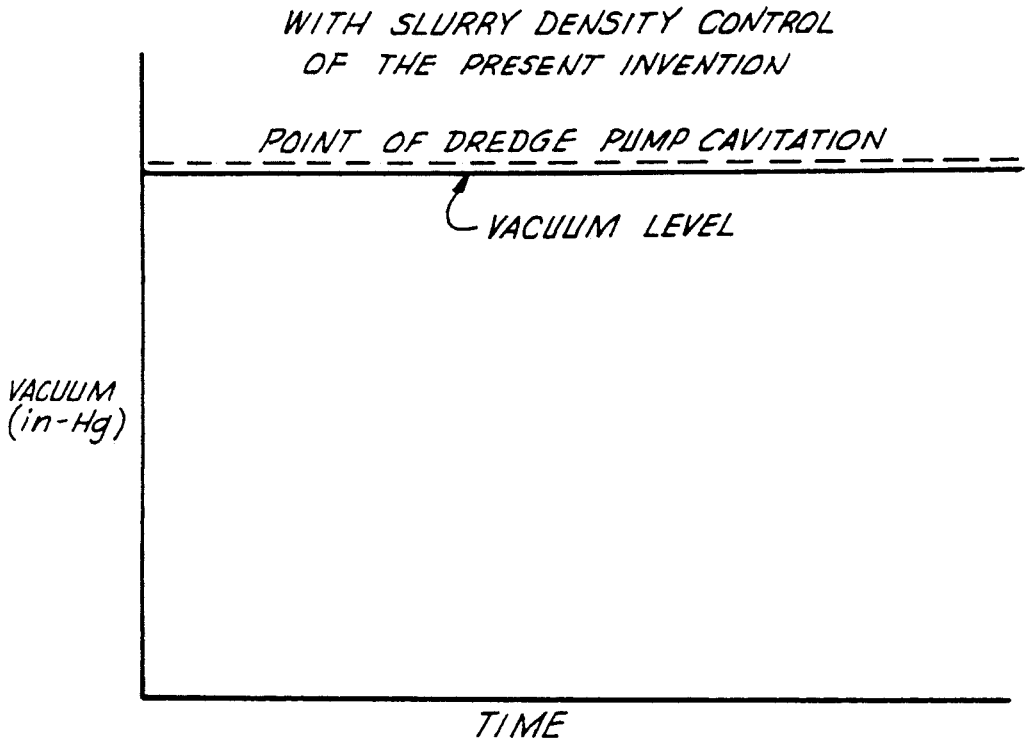
FIG. 2 shows the vacuum level which is maintained in a dredge pipe which uses the slurry density control of the present invention.
Figure 3:
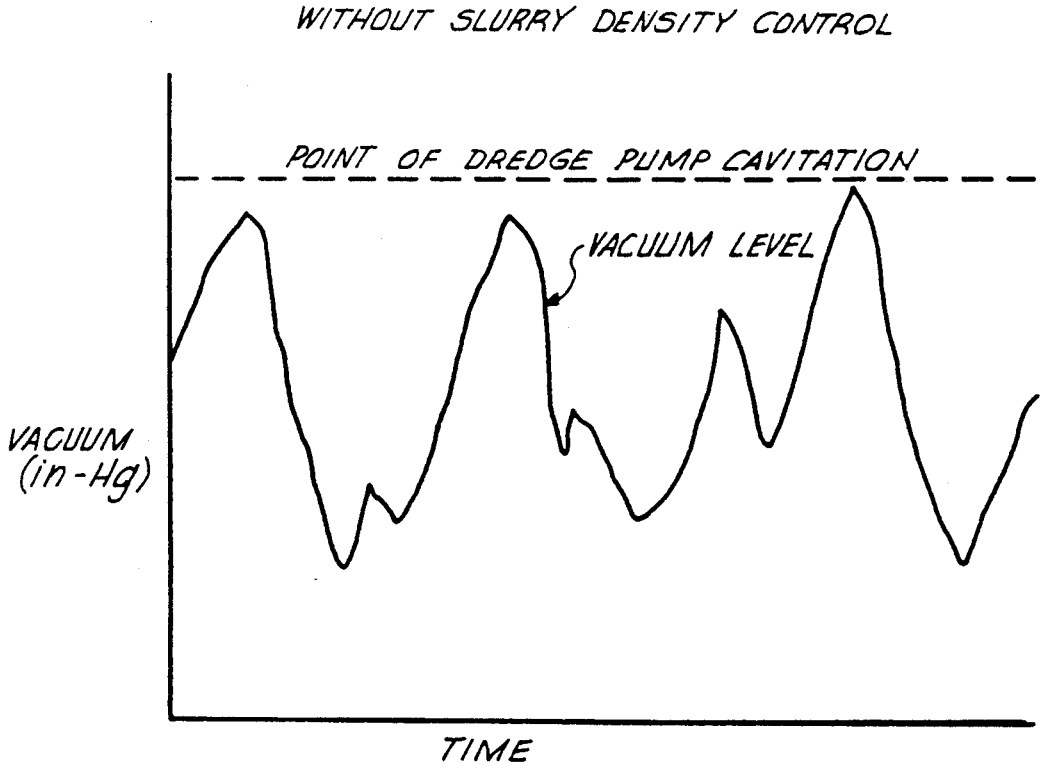
FIG. 3 shows the vacuum level in a dredge pipe which does not use slurry density control.
Figure 4:
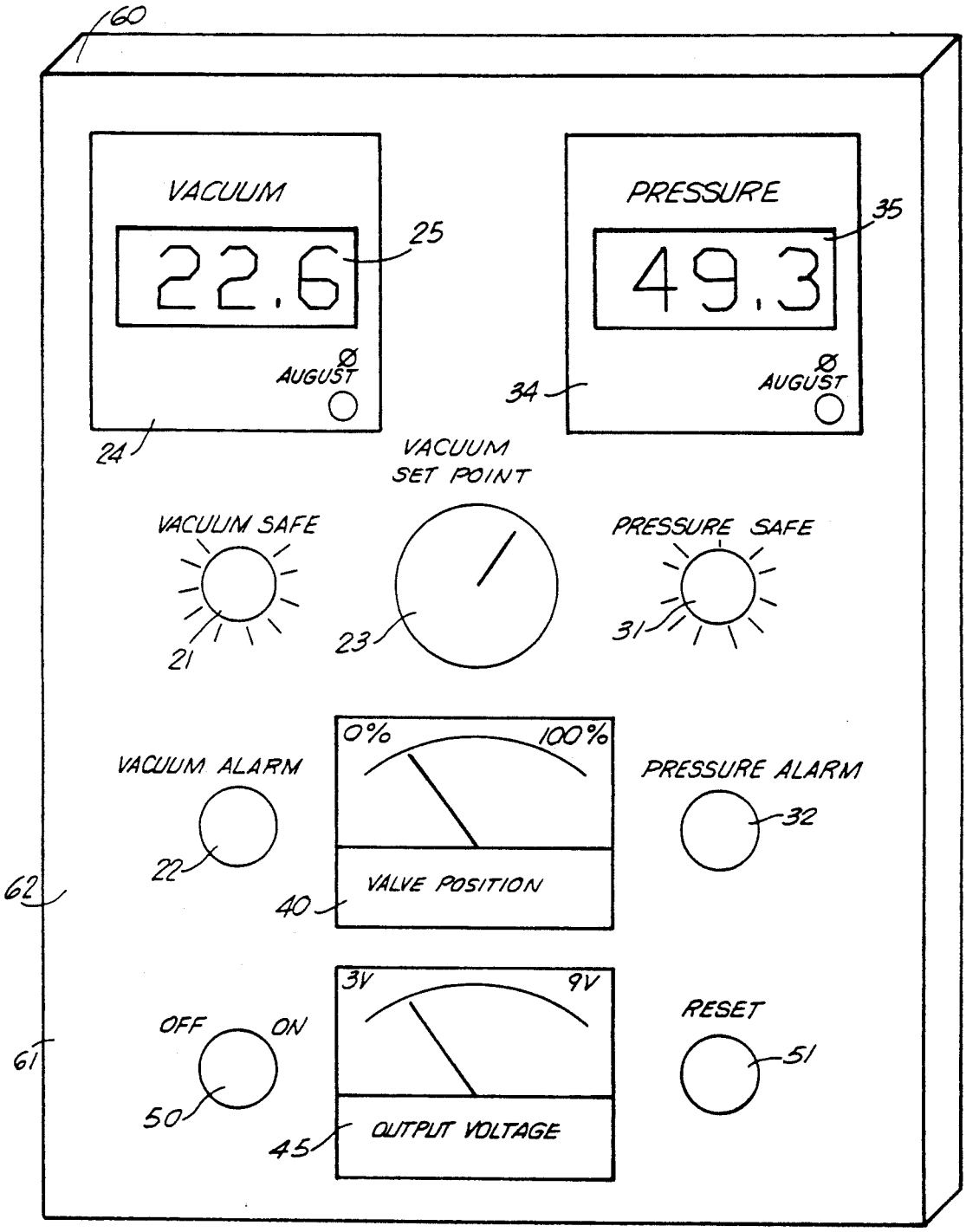
FIG. 4 is a perspective view of the control panel of the preferred embodiment of the present invention.
Figure 5:
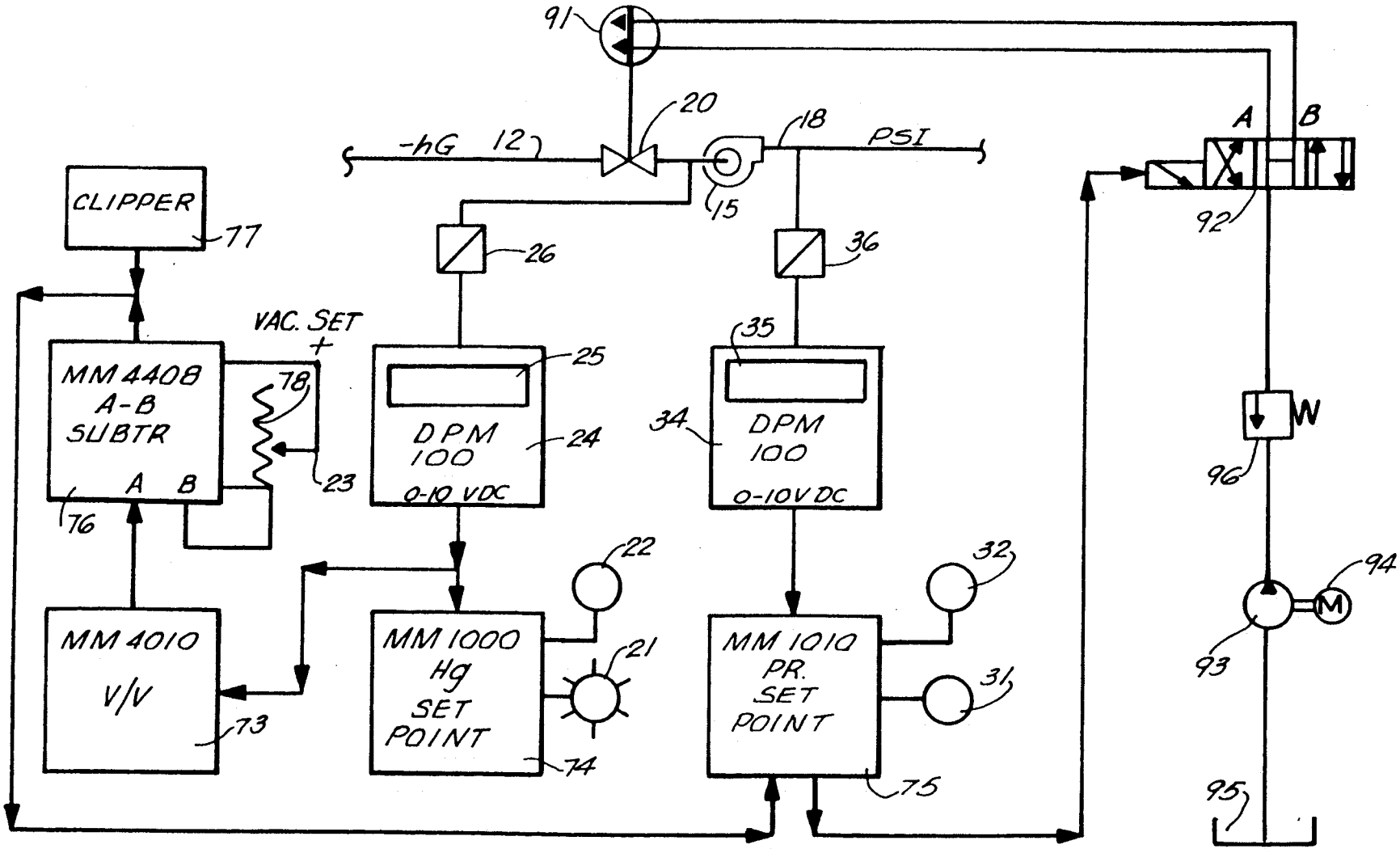
FIG. 5 is a schematic diagram showing the system of the present invention.

Barge 11 floats in a body of water 1, with the suction inlet 17 on the water bottom 3 near the material 4 to be dredged. Dredged material flows from the suction inlet 17 of suction line 12, through pump 15, and out through discharge pipe 18 into barge 11. An underwater valve 20 is present on suction line 12, and serves to allow water to enter line 12 directly to precisely maintain the vacuum level of pump 15 substantially at, but just below, cavitation level, as shown in FIG. 2. Valve 20 is controlled by valve 92, as will be described further.

The underwater valve 20 utilized in the system is a standard-type valve. If valve 20 is too large, the shaft may need to be turned down to make room for actuator 91.

The hydraulic actuator 91 is mounted on the underwater valve 20 could be a Danfoss piston actuator, but is preferably a Superfoss actuator model BRC-012 or BRC-022.

The hydraulic power unit consists of a variable volume pressure compensated 6 GPM Denison pump 93 driven by a 10 HP electric motor 94. An in-line flow control valve 92 controls speed. Control valve 92 is electrically proportional; this allows the electronics to regulate the position of the underwater valve 20. Pump 93 delivers oil from tank 95 to hydraulic actuator 91. When proportional control valve 92 does not permit oil flow to actuator 91, oil is returned to tank 95 via relief valve 96.

ELECTRONICS

The electronics utilized in this system are designed to monitor discharge pressure and inlet vacuum conditions of dredge pump 15. This supplies the output signal to the electronic proportional control valve 92.

Vacuum meter 24 gives constant vacuum measurement to one decimal place on digital display 25. Meter 24 is equipped with a zero adjustment which is located on the lower right hand face of meter 24. The zero adjustment should be made only when dredge pump 15 is not operating.

Vacuum safe light 21 indicates that the measured vacuum is below the set point.

Vacuum alarm light 22 determines the maximum level of vacuum the operator wants the dredge pump 15 to operate at.

TO ADJUST VACUUM SET POINT 23

1) Turn the vacuum set point dial 23 clockwise until it contacts the stop. DO NOT FORCE THE DIAL.
2) Load the dredge pump 15 to desired vacuum level.
3) Slowly turn the set point dial 23 counter-clockwise until you see the valve position indicator 40 move or the output voltage, as indicated on output voltage meter 45, rise above (6) volts.

Once the set point is obtained, the system should maintain that vacuum pressure as long as good material is feeding to the suction inlet 17.

Valve position indicator 40 is optional meter which shows the physical position of the underwater valve 20 from 0% to 100% open.

Output voltage meter 45 shows the output voltage going to the hydraulic proportional control valve 92 that operates the underwater valve 20. The range is three to nine volts.

Three-six volts = Underwater valve 20 closing
Six-nine volts = Underwater valve 20 opening
Nine volts = Underwater valve 20 fully opened Meter 45 is intended to monitor output voltage and is not a good indication of the actual position of valve 20. Meter 45 only tells the operator whether valve 20 is opening or closing — the degree of opening is read on valve position meter 40.

Pressure meter 34 gives constant discharge pressure measurement to one decimal place on digital display 35. Meter 34 is equipped with a zero adjustment which is located on the lower right hand face of meter 34. The zero adjustment should be made only when the dredge pump 15 is not operating.

Pressure safe light 31 indicates that the measured pressure is below the pressure set point. Pressure alarm light 32 indicates that the measured pressure is above the pressure set point.

The pressure set point is an internal adjustment that is made on the MM (Mighty Module) module inside the electronics enclosure 60. This adjustment can be made with a small screwdriver by turning set point adjustment counter-clockwise to lower pressure set point. Pressure can be raised by turning adjustment clockwise to reach desired pressure.

Anytime the pressure alarm is triggered, press and hold the reset button 51 for three (3) seconds to return to normal operation. Also, if at any time the system does not seem to be operating properly, try pressing the reset button 51 and hold for three (3) seconds before making any adjustments.

On/off switch 50 simply supplies power to the control electronics.

TROUBLE SHOOTING

In the event of any operational problems, the following information should be recorded to assist HYDRADYNE/GENERAL HYDRAULICS in determining where the problem has occurred.

1) With the ladder raised, what does the underwater valve 20 do in relation to clockwise or counter-clockwise adjustment of the vacuum set point adjustment 23?

2) What is the color of the light on the hydraulic proportional valve 92?

3) What lights are operating on the electronic control panel 61?

4) What is the oil level in the hydraulic tank 95?

5) What is the oil temperature?

6) What are the vacuum and pressure meters 24 and 34 reading?

7) Are the fuses in the electronics enclosure 60 OK?-

With the dredge operating:

1) What are the vacuum and pressure meters 24 and 34 reading?
2) What is the output voltage?
3) What is the reading of the valve position meter 40?
4) What lights are operating?
5) What happens to valve position meter 40 or output voltage meter 45 when you turn vaccum set point 23 counter-clockwise till it contacts stop?
6) What happens when you press the reset button 51 and hold for three seconds?

MAINTENANCE

The hydraulic system should be checked for leaks periodically. The temperature and oil level should be checked weekly. The return filters on the hydraulic power unit should be changed whenever indicator is in the red or every six months. Change oil in hydraulic system every six months. New oil should be filtered to a minimum of ten microns. This can be accomplished with any standard hydraulic filter cart.

The slurry density control unit consists of fiber glass electronics enclosure 60 with all electrical and electronic components, a hydraulic power unit with electric motor 94, pump 93, and relief valve 96 mounted on a suitable tank 95, a hydraulic rotary actuator 91 with water valve 20 and 0-20 mA valve position driver, and a PVEH32 electro-proportional valve 92 with Red-Green alarm LED.

The control panel 61 of the FIBER GLASS electronics enclosure 60 consists of two digital panel meters 24 and 34, meter 24 being for pressure and meter 34 being for vacuum, with matched transducers 26 and 36, respectively, a green vacuum alarm light 21 marked "Vacuum Safe" and a red vacuum alarm light 22 marked "Vacuum Alarm", a valve position analog indicator meter 40 marked "0%-100%", a green pressure alarm light 31 marked "Pressure Safe" and a red pressure alarm light 32 marked "Pressure Alarm", a 0-10 VDC analog meter 45 marked "Output Voltage", an On-Off two position switch 50, a push button reset switch 51 marked "Reset", a vacuum set point knob 23 labeled "Vacuum Set Point", and an engraved panel 62 with appropriate nomenclature.

Inside enclosure 60 are a 12 VDC regulated power supply 70, a barrier strip with ten connectors, a 24 VDC regulated power supply 71, an isolation transformer 72, a fuse F1, a MM4010 Wilkerson DC-to-DC signal level conditioning module 73, a MM1000 Wilkerson non-latch vacuum limit alarm module 74, a MM1010 Wilkerson latch type pressure limit alarm 75, a MM4408 Wilkerson A-B subtractor transmitter 76, a board mounted diode-resistor clipper network 77, a 9 VDC resistor network 78, a potentiometer knob 23 for resistor network on 3-9 VDC control marked "Vacuum Set Point", and a 120 VAC 1ϕ4" Muffin cooling fan 79.

THEORY OF OPERATION

Vacuum transducer 26 is situated in the inlet side of the main pump 15 and produces a 0-100 mV output in relation to the inlet pump vacuum level. This signal is directed to the vacuum panel meter 24 where the results are digitized and displayed on a single-decimal three-element LCD 25. The resulting output is also converted to a 0-10 VDC signal and directed to recorder output terminals.

The 0-10 VDC recorder signal is then directed to MM4010 DC-to-DC signal level module 73 where the signal level output is converted to a 3-9 VDC signal level ratio. The input signal is also directed parallel with and to the input of MM1000 non-latch vacuum limit alarm 75.

The MM1000 vacuum limit alarm module 74 monitors the pump inlet vacuum and trips a relay when the input vacuum exceeds a preset value determined by the criteria of the individual dredge pump 15.

Alarm lights 21 and 22 on the front panel 61 are controlled by MM1000 module 74. Alarm light 21 is green and is labeled "Vacuum Safe"; alarm light 22 is red and is labeled "Vacuum Alarm". Lights 21 and 22 give the dredge operator instantaneous visual reference as to the safe level of vacuum on the main pump 15 to prevent cavitation. The vacuum alarm condition does not inhibit the operation of the density control circuit in any way; it is merely a visual indication of a pre-selected vacuum level based on the criteria of dredge pump 15.

Figure 6:
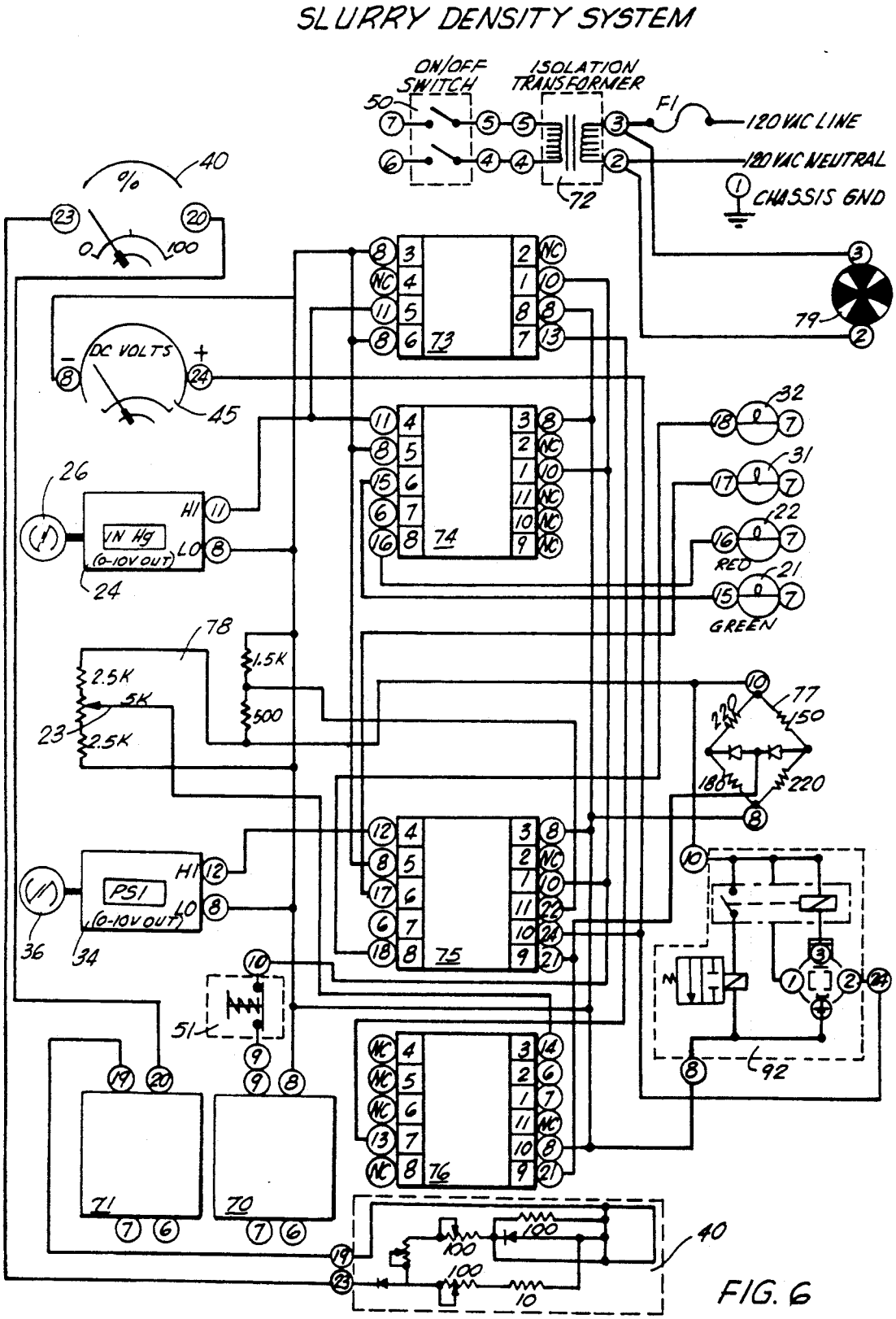
FIG. 6 is a circuit diagram of the slurry density system of the present invention.

The output of MM4010 module 73, a 3-9 VDC signal, is directed to the A input of the MM4408 A-B subtractor transmitter module 76 (see FIG. 6).

The B input to the MM4408 subtractor transmitter 76 comes from the 5K pot resistor network 23 labelled "Vacuum Set Point" on the front panel 61. This network is also a 3-9 VDC signal.

When both A and B inputs are at the same level; i.e. A at 3 VDC and B at 3 VDC, the output from MM4408 76 is 6 VDC. Any inequity in either input will cause the output of MM4408 module 76 to go toward 3 VDC or toward 9 VDC depending upon which input is greater.

The pressure transducer 36 is situated in the pump discharge of dredge pump 15 and produces a 0-100 mV signal output in relation to the pump outlet pressure of dredge pump 15. This signal is directed to the pressure digital panel meter 34 where the results are digitized and displayed on a three-element LCD 35. The resulting output is also converted to a 0-1- VDC signal and directed to the pressure recorder output terminals.

The 0-1- VDC pressure recorder signal is then directed to the input terminal of the MM1010 pressure latch type limit alarm 75.

Module 75 monitors the output pressure of the main pump 15 and trips two relays when the pump output pressure exceeds a preset value determined by the criteria of the individual dredge pump 15.

Relay One (see FIG. 6) of MM1010 module 75 controls lights 31 and 32.

Relay Two of the MM1010 module 75 directs the output signal from module MM4408 76 and the signal from the board mounted diode resistor clipper network 77 to the control pin of the PVEH32 proportional valve 92. This occurs only when Relays One and Two of the module MM1010 75 are in the Pressure Safe condition.

When pressure in the discharge system exceeds a preset value, Relay One of module 75 turns off the "Pressure Safe"green light 31 and turns on the "Pressure Alarm" red light 32. Relay Two disconnects the output from MM4408 module 76 and resistor clipper network 77 then directs a 9 VDC signal from a resistor network to the control pin of PVEH32 proportional hydraulic valve 92.

The PVEH32 electro proportional valve 92 has a three pin converter, a ground pin, a 12 VDC positive pin and a control pin.

With a 6 VDC on the control pin, the valve is in neutral hence no oil flow from A or B ports. With a proportional voltage between 3-6 VDC, proportional oil flow will occur from port A to B, causing valve 20 to move toward a closed position, allowing less water to pass therethrough. With a proportional voltage of 6-9 VDC, proportional oil flow will occur from port B to A, causing valve 20 to move more to a fully open position to allow more water to pass therethrough.

The MM4408 subtractor transmitter 76 and diode resistor network has about a 0.5 inch Hg dead band. Adjusting the Vacuum Set Point pot-3-9 VDC requires that the DC level from the MM4010 module 73 3-9 VDC must be higher for the PVEH32 valve 92 to supply oil to open the actuator 91 controlled water valve 20. Any voltage balance between the MM4010 output and the Vacuum Set Point port causes the PVEH32 valve 92 to go to neutral.

The Vacuum Set Point control 23 sets up a threshold voltage thereby giving the operator the ability to change the slurry density in relation to the type of material, if needed.

The slurry density will remain constant as long as the vacuum alarm or pressure alarm does not show a red light (i.e., as long as lights 22 and 32 are off).

When the pressure alarm condition occurs, the 9 VDC signal, as described before, forces the PVEH32 valve 92 to open the actuator 91 controlled water valve 20 to its fully open position. This module is latched out and remains in this condition until the operator holds the reset button 51 down for about three seconds. If the fault condition remains, the MM1010 module 75 will not relatch until the fault condition is corrected. This feature is designed to protect the discharge pipe 18 from becoming plugged due to excessive material.

A 0-1- VDC analog meter 45 is connected across the final control voltage output to pin 2 of the PVEH32 valve 92 to monitor control voltage. This gives the operator a visual indication of voltage levels and valve direction (i.e., below 6 VDC valve 20 is closing; above 6 VDC the valve 20 is opening, and a steady 9 VDC indicates a pressure alarm).

A 24 VDC supply 71 is directed to a 0-20 mA driver mounted on and driven by hydraulic actuator 91. This current is in series with a 0-20 mA analog ammeter 40 that reads 0%-100%, giving the operator a visual reference as to the position of water valve (i.e., valve 20 closed 0%-open 100% at 0° to 90 °, respectively, of actuator rotation).

All components are selected for quality and are hand wired.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A suction dredge for mining solids from a water bottom, comprising:

(a) a floating barge;

(b) an elongated tubular suction line extending between the barge and the water bottom;

(c) boom means for raising and lowering the elongated tubular suction line:

(d) a valve means in the elongated tubular suction line for allowing water to enter the elongated tubular suction line;

(e) dredge pump means for causing solids to be drawn upward from the water bottom, through the elongated tubular suction line, to the floating barge, the dredge pump means having a cavitation level at which the vacuum level is so high that the dredge pump means ceases to pump; and (f) automatic control means for controlling the degree of opening of the valve means, the automatic control means allowing just enough water to mix with the solids such that the dredge pump means is maintained substantially at but below the cavitation level, the automatic control means including measuring means for measuring the vacuum level of the dredge pump means, and causes the valve means to open more as the vacuum level rises and to close more as the vacuum level drops.

2. The suction dredge of claim 1, further comprising:

(g) means for displaying the vacuum level of the dredge pump means;

(h) means for displaying the discharge pressure of the dredge pump means; and (i) means for displaying the percentage of opening of the valve means.

3. The suction dredge of claim 2, further comprising:

(j) means for displaying the direction in which the valve means is moving.

4. The suction dredge of claim 3, further comprising:

(k) means for fully opening the valve means when the discharge pressure of the pump means exceeds a predetermined value.

5. The suction dredge of claim 4, further comprising:

(l) a first indicating light for indicating that the vacuum level of the pump means is at a safe level;

(m) a second indicating light for indicating that the discharge pressure of the pump means is not above a predetermined amount.

6. The suction dredge of claim 5, further comprising:

(n) a third indicating light for indicating that the vacuum level of the pump means is above a safe level;

(o) a fourth indicating light for indicating that the discharge pressure of the pump means is above a predetermined amount.

7. A suction dredge for mining solids from a water bottom, comprising:

(a) a floating barge;

(b) an elongated tubular suction line extending between the barge and the water bottom;

(c) a boom for raising and lowering the elongated tubular suction line:

(d) a valve in the elongated tubular suction line for allowing water to enter the elongated tubular suction line;

(e) a dredge pump for causing solids to be drawn upward from the water bottom, through the elongated tubular suction line, to the floating barge, the dredge pump having a cavitation level at which the vacuum level is so high that the dredge pump ceases to pump; and (f) an automatic control means for controlling the degree of opening of the valve, the automatic control means allowing just enough water to mix with the solids such that the dredge pump is maintained substantially at but below the cavitation level, the automatic control means including a measuring device for measuring the vacuum level of the dredge pump, and causes the valve to open more as the vacuum level rises and to close more as the vacuum level drops.

8. The suction dredge of claim 7, further comprising:

(g) a first display for displaying the vacuum level of the dredge pump;

(h) a first display for displaying the discharge pressure of the dredge pump; and (i) a third display for displaying the percentage of opening of the valve.

9. The suction dredge of claim 8, further comprising:

(j) a fourth display for displaying the direction in which the valve is moving.

10. The suction dredge of claim 9, further comprising:

(k) a device for fully opening the valve when the discharge pressure of the pump exceeds a predetermined value.

11. The suction dredge of claim 10, further comprising:

(l) a first indicating light for indicating that the vacuum level of the pump is at a safe level;

(m) a second indicating light for indicating that the discharge pressure of the pump is not above a predetermined amount.

12. The suction dredge of claim 11, further comprising:

(n) a third indicating light for indicating that the vacuum level of the pump is above a safe level;

(o) a fourth indicating light for indicating that the discharge pressure of the pump is above a predetermined amount.

13. The suction dredge of claim 7, wherein the automatic control device includes:

an electro-proportional hydraulic system.

14. A suction dredge for mining solids from a water bottom, comprising:

(a) a floating barge;

(b) an elongated tubular suction line extending between the barge and the water bottom;

(c) boom means for raising and lowering the elongated tubular suction line:

(d) a valve means in the elongated tubular suction line for allowing water to enter the elongated tubular suction line;

(e) dredge pump means for causing solids to be drawn upward from the water bottom, through the elongated tubular suction line, to the floating barge, the dredge pump means having a cavitation level at which the vacuum level is so high that the dredge pump means ceases to pump; and (f) automatic control means for controlling the degree of opening of the valve means, the automatic control means allowing just enough water to mix with the solids such that the dredge pump means is maintained substantially at but below the cavitation level, the automatic control means including measuring means for measuring the vacuum level of the dredge pump means, and causes the valve means to open more as the vacuum level rises and to close more as the vacuum level drops;

(g) means for displaying the vacuum level of the dredge pump means;

(h) means for displaying the discharge pressure of the dredge pump means;

(i) means for displaying the percentage of opening of the valve means;

(j) means for displaying the direction in which the valve means is moving;

(k) means for fully opening the valve means when the discharge pressure of the pump means exceeds a predetermined value;

(l) a first indicating light for indicating that the vacuum level of the pump means is at a safe level;

(m) a second indicating light for indicating that the discharge pressure of the pump means is not above a predetermined amount;

(n) a third indicating light for indicating that the vacuum level of the pump means is above a safe level; and (o) a fourth indicating light for indicating that the discharge pressure of the pump means is above a predetermined amount.

15. The suction dredge of claim 14, wherein the automatic control means includes:

an electro-proportional hydraulic system.

* * * * *